US006840608B2

(12) United States Patent
Jung et al.

(10) Patent No.: US 6,840,608 B2
(45) Date of Patent: Jan. 11, 2005

(54) INK CARTRIDGE USED WITH AN INK JET PRINTER

(75) Inventors: Myung-song Jung, Gyeonggi-do (KR); Young-su Lee, Gyeonggi-do (KR); Jeong-seon Kim, Gyeonggi-do (KR); Moo-youl Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 3 days.

(21) Appl. No.: 10/287,817

(22) Filed: Nov. 5, 2002

(65) Prior Publication Data

US 2003/0090553 A1 May 15, 2003

(30) Foreign Application Priority Data

Nov. 5, 2001 (KR) ..... 2001-68632

(51) Int. Cl.[7] ..... B41J 2/175
(52) U.S. Cl. ..... 347/86; 347/87
(58) Field of Search ..... 347/85, 86, 87

(56) References Cited

U.S. PATENT DOCUMENTS 4,992,802 A * 2/1991 Dion et al. ..... 347/87
5,541,632 A 7/1996 Khodapanah et al.
5,574,490 A * 11/1996 Gragg et al. ..... 347/87
2003/0067520 A1 * 4/2003 Inoue et al. ..... 347/86

* cited by examiner

*Primary Examiner*—Anh T. N. Vo
(74) *Attorney, Agent, or Firm*—Staas & Halsey LLP

(57) ABSTRACT

An ink cartridge for an ink jet printer is provided. The provided ink cartridge has an ink reservoir and a housing for covering the ink reservoir with a negative pressure maintenance unit therebetween, to maintain the inner pressure of the ink reservoir under a negative pressure. Since the negative pressure maintenance unit does not contact ink in the ink reservoir, the negative pressure maintenance unit does not corrode. In addition, the negative pressure maintenance unit is installed between the housing and the ink reservoir while occupying a small space, and thus improving the filling efficiency of ink in the ink reservoir.

14 Claims, 6 Drawing Sheets

INK CARTRIDGE USED WITH AN INK JET PRINTER

Figure 1:
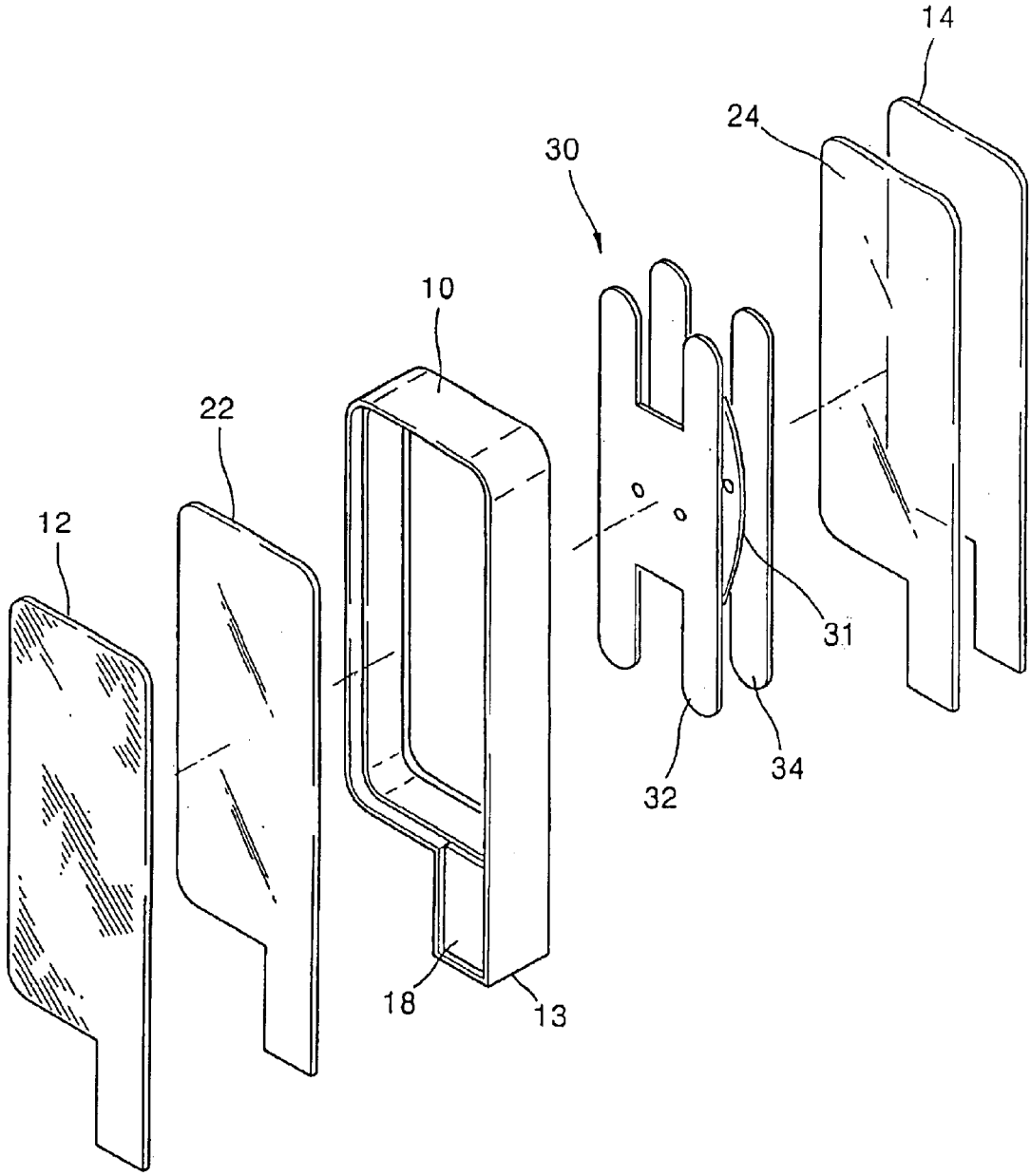
FIG. 1 is a separate perspective view illustrating a conventional ink cartridge.

*Explanation of Reference Numerals Designating the Major Elements of the Drawings

| | | | |
|---|---|---|---|
| 100 | base plate | 102 | cover plate |
| 104 | flexible walls | 114 | print head |
| 130 | leaf spring | | |

DETAILED DESCRIPTION OF THE INVENTION

[Object of the Invention]

[Technical Field of the Invention and Related Art Prior to the Invention]

The present invention relates to an ink cartridge for an ink jet printer, and more particularly, to an ink cartridge for maintaining the inside of an ink reservoir under a proper negative pressure.

An ink cartridge for an ink jet printer generally reserves ink to discharge ink droplets through a print head so that a colored image is printed on a sheet.

The ink cartridge requires a device for maintaining the inside of an ink reservoir under a negative pressure, in order to prevent an excessive amount of ink from leaking through the print head in a printing state or a wetting occurrence at the print head in an idle state.

FIG. 1 illustrates an ink cartridge having a negative pressure maintenance unit. Referring to FIG. 1, the ink cartridge includes a housing and an ink reservoir arranged in the housing to reserve ink, while having a negative pressure maintenance unit 30. The housing includes a frame 10, and side plates 12 and 14 for sealing both sides of the frame 10. The ink reservoir is sealed by flexible walls 22 and 24, which may be transformed while maintaining the inside of the ink reservoir in a sealed state. The negative pressure maintenance unit 30 maintains the inside of the ink reservoir under a proper negative pressure. Thus, ink is prevented from dripping through a print head 13 when discharging the ink from the ink reservoir through the print head 13 by passing through a filter 18 or when reserving the ink in the ink reservoir. In this case, the negative pressure maintenance unit 30 has a bow spring 31 and plates 32 and 34 for supporting the bow spring 31. In this case, the bow spring 31 applies a negative pressure to the flexible walls 22 and 24 while ink is reserved in the ink reservoir, and the plates 32 and 34 transfer a force from the bow spring 31 to the flexible walls 22 and 24.

In the ink cartridge of the above configuration, since the bow spring 31 directly contacts the ink reserved in the ink reservoir, the bow spring 31 may corrode by chemical reaction with the ink.

Accordingly, preventing the bow spring 31 from corroding is required. However, forming the bow spring 31 by using a material which does not react with inks, limits the range of materials for the bow spring 31 and increases the price of the selected material. An alternative plan for changing the main element and additives of the ink also limits the selecting range for ink and increases the price of the ink.

[Technical Goal of the Invention]

To solve the above-described problems, it is an objective of the present invention to provide an ink cartridge for an ink jet printer, which prevents a negative pressure maintenance unit from corroding and improves the filling efficiency of ink.

[Structure and Operation of the Invention]

To accomplish the objective of the present invention, an ink cartridge for an ink jet printer has an ink reservoir for reserving ink, a housing for covering the ink reservoir, and a negative pressure maintenance unit for maintaining the inner pressure of the ink reservoir under a negative pressure. The reservoir includes a base plate, a cover plate separated from the base plate, and flexible walls interposed between the base plate and the cover plate for forming a sealed space to reserve ink. Here, the negative pressure maintenance unit includes at least one elastic member for being interposed between the housing and the cover plate.

It is preferable that the elastic member is a leaf spring for maintaining the inner pressure of the ink reservoir under the negative pressure by applying an elastic restoring force in a pulling direction of the cover plate.

The leaf spring has a housing fixing portion fixed to the housing, plate fixing portions fixed to the cover plate, and connecting portions for integrally connecting the housing fixing portion and plate fixing portion.

It is preferable that the housing is formed by fixing first and second body portions that are facing each other or by fixing a wall body having a through hole and a cover for sealing one side of the wall body, so that the housing is coupled with the base plate to cover the ink reservoir. In addition, it is preferable that the housing is formed of one selected from a sheet metal and structural polymer.

Hereinafter, a preferred embodiment according to the present invention will be described in detail with reference to the attached drawings.

Figure 2:
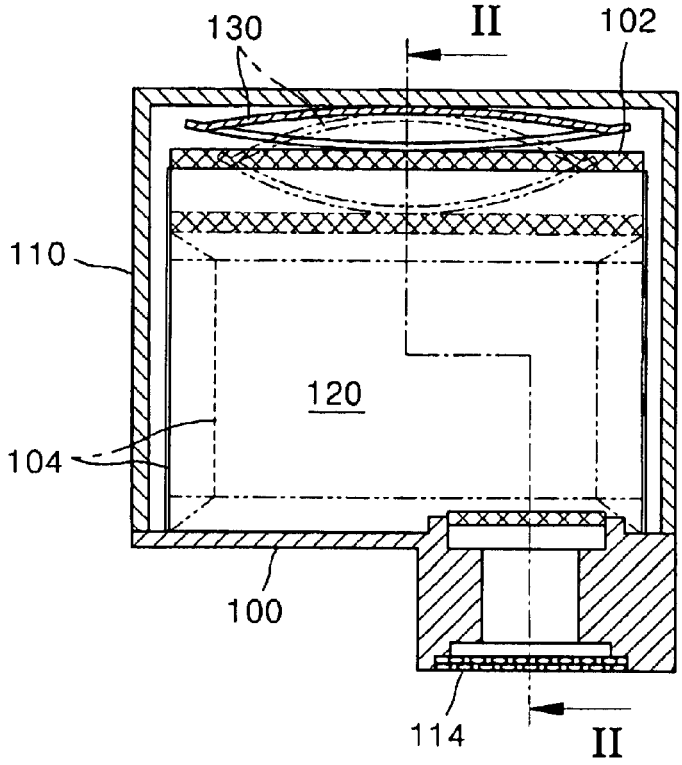
FIG. 2 is a sectional view illustrating an ink cartridge according to an embodiment of the present invention.
Figure 3:
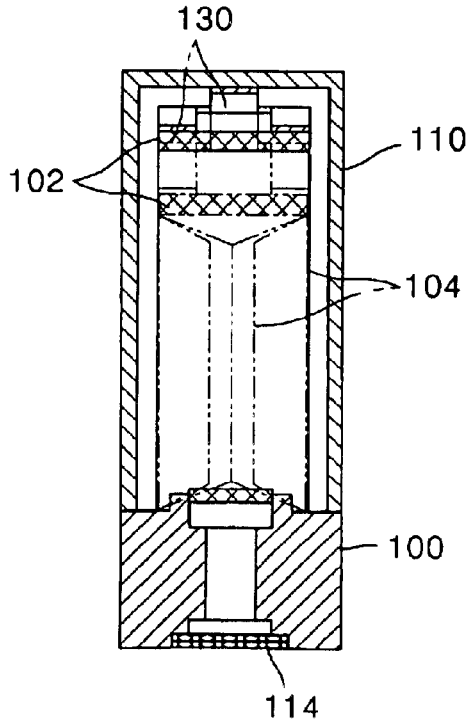
FIG. 3 is a sectional view illustrating the ink cartridge according to the embodiment of the present invention along the cutting plane line II—II of FIG. 2.

FIG. 2 is a sectional view illustrating an ink cartridge according to an embodiment of the present invention, and FIG. 3 is a sectional view illustrating the ink cartridge along the cutting plane line II—II of FIG. 2. Referring to FIGS. 2 and 3, the ink cartridge includes an ink reservoir 120, a housing 110, and a leaf spring 130 as a negative pressure maintenance unit.

The ink reservoir 120 contains a base plate 100, a cover plate 102, and flexible walls 104 for sealing a space between the plates 100 and 102. In this case, the cover plate 102 moves vertically according to the amount of ink in the ink reservoir 120. The flexible walls 104 formed of a flexible material are attached to the edges of the base plate 100 and the cover plate 102 that face each other, so that a sealed space is formed.

The housing 110 has an opening in the area of which the housing 110 is coupled with the base plate 100 by welding, i.e., a thermal or ultrasonic welding, or by using a combining unit, i.e., a screw or hook, so that the housing 110 with the base plate 100 covers the ink reservoir 120.

Figure 4A:
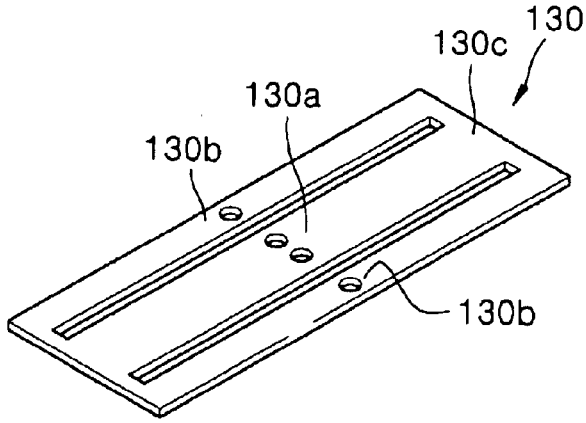
FIGS. 4A through 4C illustrate a first example of a leaf spring used in the ink cartridge according to the present invention, in particularly, an initial state, and before and after the operation of the leaf spring.
Figure 4B:
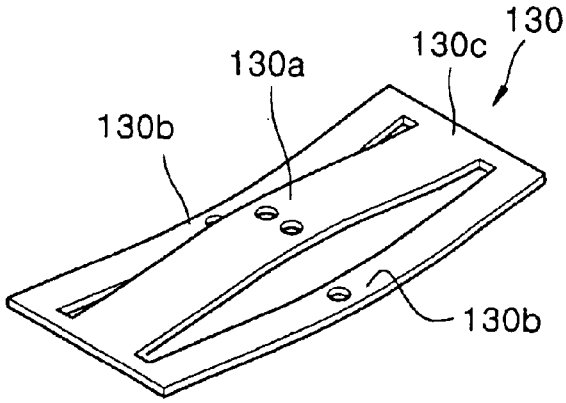
Figure 4C:
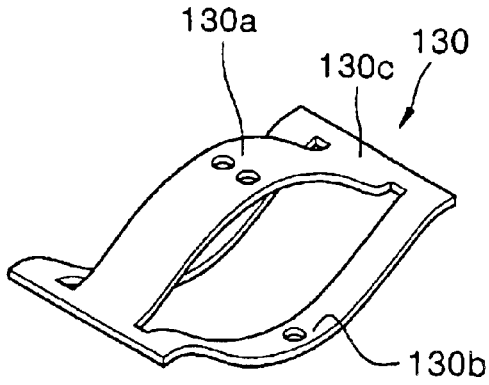

The housing 110 and the cover plate 102 of the ink reservoir 120 are arranged with the leaf spring 130 therebetween, and the initial state, and before and after operation states of the leaf spring 130 are illustrated in FIGS. 4A through 4C. Referring to FIGS. 4A through 4C, the leaf spring 130 includes a housing fixing portion 130*a* fixed to the housing 110, plate fixing portions 130*b* fixed to the cover plate 102, and connecting portions 130*c* for connecting the fixing portions 130*a* and 130*b*. In this case, the housing and plate fixing portions 130*a* and 130*b* are fixed to the housing 110 and the cover plate 102 by a welding method or by using a combining unit like a screw or hook, respectively. The leaf spring 130 is flat in the initial state. When installing the leaf spring 130 in the ink cartridge, the leaf spring 130 is transformed toward an operation direction to a small amount as shown in FIG. 4B. Since strain energy accumulates in the leaf spring 130 due to the transformation, the strain energy generates an elastic restoring force for pulling the cover plate 102 of the ink reservoir 120. Consequently, a negative pressure, under an external atmospheric pressure, is formed in the ink reservoir 120. As the ink is discharged through a print head 114 and the amount of ink in the ink reservoir 120 decreases, the flexible walls 104 contract toward an inner direction as illustrated in FIGS. 2 and 3 by dotted lines. Accordingly, the cover plate 102 moves toward the base plate 100. In this case, the transformation of the leaf spring 130 increases to move the cover plate 102, so that the negative pressure in the ink reservoir 120 is maintained within a predetermined range. FIG. 4C illustrates the final state of the leaf spring 130.

Figure 5A:
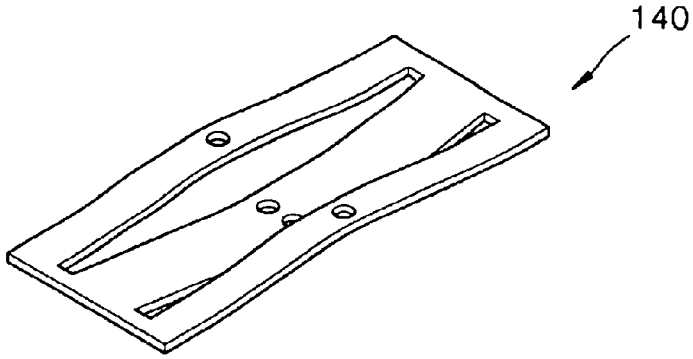
FIGS. 5A through 5C illustrate a second example of a leaf spring used in the ink cartridge according to the present invention, in particularly, an initial state, and before and after the operation of the leaf spring, respectively.
Figure 5B:
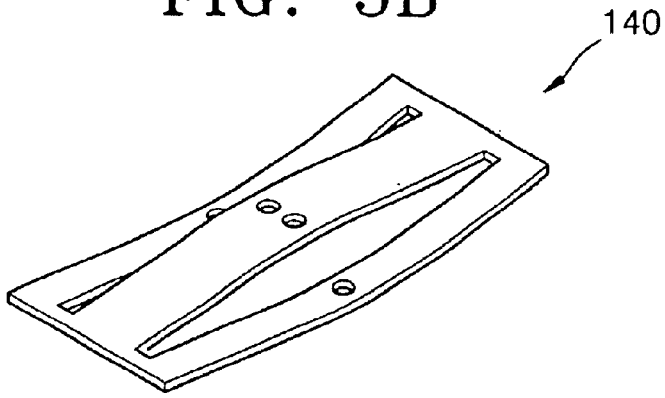
Figure 5C:
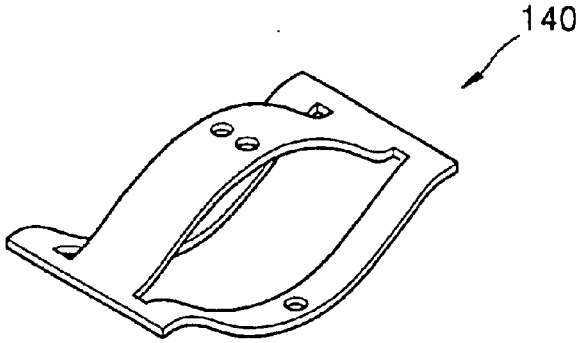

FIGS. 5A through 5C illustrate a second example of a leaf spring used in the ink cartridge according to the present invention, in particular, an initial state, and before and after operation states of the leaf spring. Although the shapes of the leaf springs 130 and 140 are identical, the leaf spring 140 is transformed in an opposite direction from the operation direction of the leaf spring 130 as shown in FIG. 5A. The leaf spring 140 is installed in a transformed state toward the operation direction as shown in FIG. 5B. Accordingly, the restoring force is generated for pulling the cover plate 102. FIG. 5C illustrates the final state of the leaf spring 140.

Figure 6A:
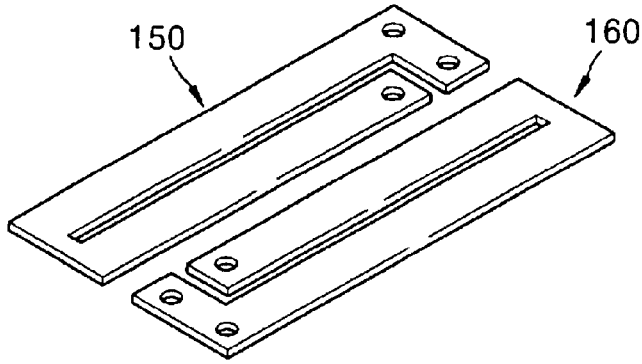
FIGS. 6A through 6C illustrate a third example of a leaf spring used in the ink cartridge according to the present invention, in particularly, an initial state, and before and after the operation of the leaf spring, respectively.
Figure 6B:
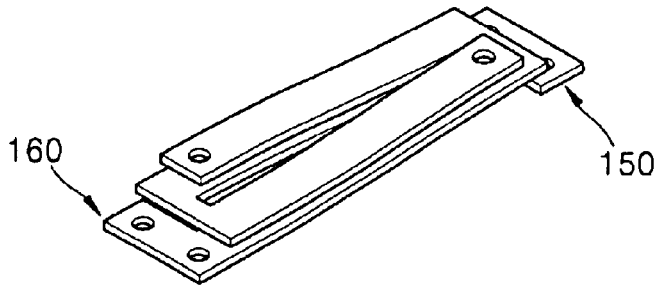
Figure 6C:
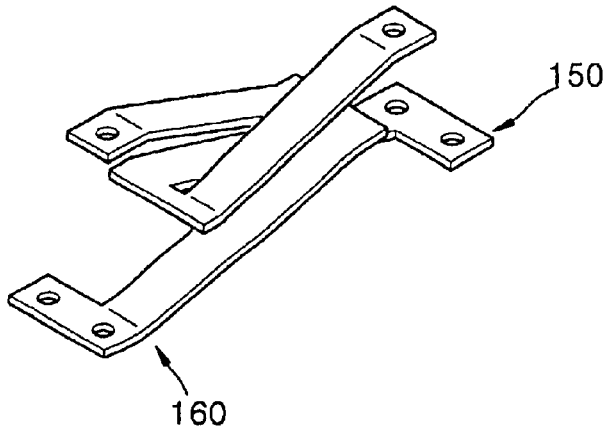

FIGS. 6A through 6C illustrate a third example of a leaf spring used in the ink cartridge according to the present invention. The leaf spring is formed by overlapping two identical leaf springs 150 and 160 inversely facing each other. The leaf springs 150 and 160 are overlapped in the state shown in FIG. 6B so that a restoring force is applied for pulling the cover plate 102. FIG. 6C illustrates the final state of the leaf springs 150 and 160.

Although a few types of leaf springs used in the ink cartridge are described above, various types of leaf springs may be used without departing from the range of the present invention.

Figure 7:
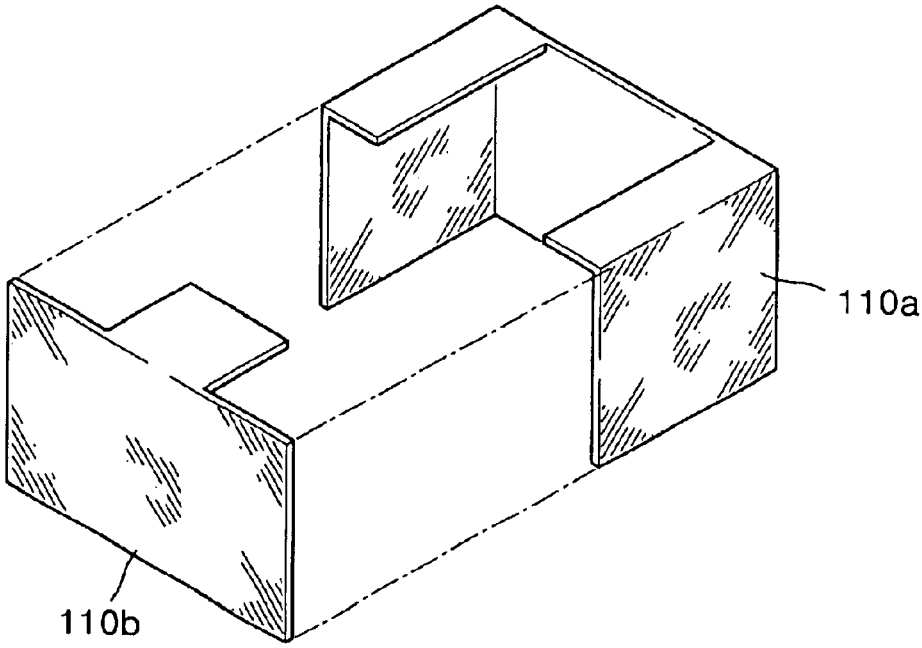
FIG. 7 illustrates a housing used in the ink cartridge according to the embodiment of the present invention.
Figure 8:
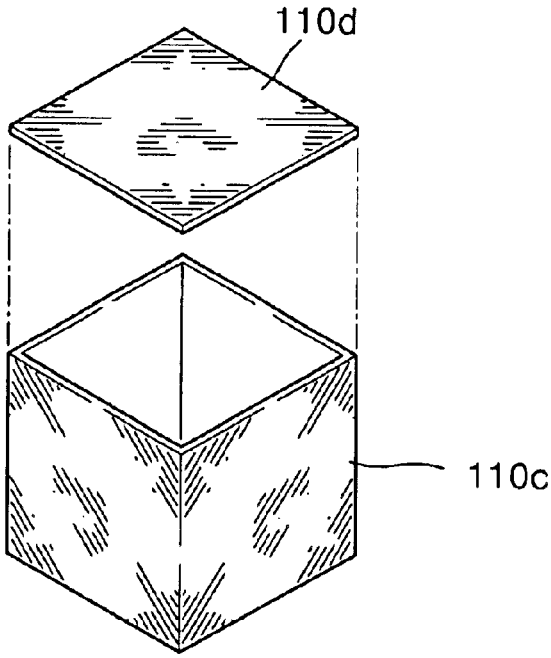
FIG. 8 illustrates another housing used in the ink cartridge according to the embodiment of the present invention.

In addition, another housing, other than an integral type housing, may be formed by coupling corresponding portions of the housing as shown in FIGS. 7 and 8. FIG. 7 illustrates the housing formed by coupling a first and second body portions 110*a* and 110*b* that are facing each other, to cover the ink reservoir 120 in FIG. 2. The first body portion 110*a* has an opened side and an upper surface with an opened portion. The second body portion 10*b* is formed in a shape for sealing the opened side and the opened portion of the upper surface of the first body portion 110*a*. The first and second body portions 110*a* and 110*b* are coupled to form the housing having an opened lower surface. The first and second body portions 110*a* and 110*b* are coupled by a welding method, such as thermal welding or ultrasonic welding, or by a mechanical coupling method using a screw or hook. In this case, the housing is formed of a processed sheet metal or structural polymer. In FIG. 8, a housing is formed by coupling a wall body 110*c* having a through hole and a cover 110*d* for sealing the upper portion of the wall body 110*c*. In this case, the material and coupling method for the wall body 110*c* and the cover 10*d* are the same as those for the housing shown in FIG. 7. Although a few types of housings used in the ink cartridge according to the present invention are described above, various types of housings may be formed without departing from the range of the present invention.

[Effect of the Invention]

Since the ink is filled only in the ink reservoir of the ink cartridge according to the present invention, changes in the physical property of the ink by vaporization of the ink are prevented. Since the inner pressure of the ink reservoir does not vary while storing the ink cartridge for a long time or at a high or low temperature, it is unlikely that the ink drips. Moreover, the leaf spring is located outside of the ink reservoir, so that the leaf spring does not corrode while having the possibility to freely select the ink and the material for the leaf spring. The leaf spring occupies a small space between the housing and ink reservoir, so that the filling efficiency of ink improves.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An ink cartridge used with an ink jet printer, the ink cartridge having an ink reservoir to reserve ink, a housing to cover the ink reservoir, and a negative pressure maintenance unit to maintain the inner pressure of the ink reservoir under a negative pressure, wherein the reservoir comprises:

a base plate;

a cover plate separated from the base plate and having an inner side facing the base plate and an opposing side; and flexible walls interposed between the base plate and the cover plate to form a sealed space to reserve ink, the negative pressure maintenance unit includes at least one elastic member interposed between the housing and the opposing side.

2. The ink cartridge of claim 1, wherein the elastic member is a leaf spring to maintain the inner pressure of the ink reservoir under the negative pressure by applying an elastic restoring force in a pulling direction of the cover plate.

3. The ink cartridge of claim 2, wherein the leaf spring has:

a housing fixing portion fixed to the housing;

plate fixing portions fixed to the cover plate; and connecting portions to integrally connect the housing fixing portion and plate fixing portion.

4. The ink cartridge of claim 3, wherein the housing fixing portion and the plate fixing portion are fixed to the housing and the cover plate, respectively, by welding.

5. The ink cartridge of claim 3, wherein the housing fixing portion and the plate fixing portion are fixed to the housing and the cover plate, respectively, by screws.

6. The ink cartridge of claim 3, wherein the housing fixing portion and the plate fixing portion are fixed to the housing and the cover plate, respectively, by hooks.

7. The ink cartridge of claim 2, wherein the cover plate moves toward the base plate.

8. The ink cartridge of claim 2, wherein the leaf spring is formed by overlapping two leaf springs inversely facing each other to provide a restoring force to pull the cover plate.

9. The ink cartridge of claim 1, wherein the housing is formed by fixing first and second body portions that are facing each other, so that the housing is coupled with the base plate to cover the ink reservoir.

10. The ink cartridge of claim 9, wherein the housing is formed of one selected from a sheet metal and structural polymer.

11. The ink cartridge of claim 9, wherein the first and second body portions are coupled to each other by thermal welding, ultrasonic welding, or by using screws or hooks.

12. The ink cartridge of claim 1, wherein the housing is formed by fixing a wall body having a through hole and a cover to seal one side of the wall body, so that the housing is coupled with the base plate to cover the ink reservoir.

13. The ink cartridge of claim 12, wherein the housing is formed of one selected from a sheet metal and structural polymer.

14. An ink cartridge comprising:

an ink reservoir having a cover thereon and a base plate;

a housing enclosing the ink reservoir and the cover having an inner side facing the base plate and an opposing outer side; and an elastic member interposed between the housing and the opposing side to maintain a constant negative pressure within the ink reservoir.

* * * * *